US009352885B2

(12) United States Patent
Hutt

(10) Patent No.: US 9,352,885 B2
(45) Date of Patent: May 31, 2016

(54) SELF-DRAINING CONTAINER

(71) Applicant: Jeffrey Michael Hutt, Marathon, FL (US)

(72) Inventor: Jeffrey Michael Hutt, Marathon, FL (US)

( * ) Notice: Subject to any disclaimer, the term of this patent is extended or adjusted under 35 U.S.C. 154(b) by 0 days.

(21) Appl. No.: 14/461,398

(22) Filed: Aug. 16, 2014

(65) Prior Publication Data

US 2015/0102034 A1 Apr. 16, 2015

Related U.S. Application Data

(60) Provisional application No. 61/961,423, filed on Oct. 15, 2013.

(51) Int. Cl.

| | |
|---|---|
| ***B65D 41/04*** | (2006.01) |
| ***B65D 43/02*** | (2006.01) |
| *B44D 3/12* | (2006.01) |
| *B65D 41/06* | (2006.01) |

(52) U.S. Cl.

CPC ..... *B65D 43/022* (2013.01); *B65D 43/0216* (2013.01); *B65D 43/0227* (2013.01); *B44D 3/127* (2013.01); *B65D 41/06* (2013.01)

(58) Field of Classification Search

CPC ..... B44D 3/12; B44D 3/127; B44D 3/128; B65D 43/0216; B65D 43/0227; B65D 43/0277; B65D 41/06; B65D 43/022

USPC ..... 220/699–701, 293, 298, 300, 301, 220/DIG. 6, 784, 787, 788, 799, 800

See application file for complete search history.

(56) References Cited

U.S. PATENT DOCUMENTS

| | | | | | |
|---|---|---|---|---|---|
| 2,084,084 | A * | 6/1937 | Greer | 220/798 | |
| 2,885,108 | A * | 5/1959 | Donoghue | 220/798 | |
| 3,326,409 | A * | 6/1967 | Speer | 220/698 | |
| 4,279,358 | A * | 7/1981 | Jacobs | 220/321 | |
| 4,723,686 | A * | 2/1988 | Pennisi | 220/300 | |
| 4,844,281 | A | 7/1989 | Bradford | | |
| 4,928,846 | A * | 5/1990 | Murrin, Jr. | 220/797 | |
| 4,964,527 | A | 10/1990 | Martin | | |
| 5,212,869 | A | 5/1993 | Zacharchuk | | |
| 5,421,457 | A | 6/1995 | Listenberger | | |
| 5,735,427 | A * | 4/1998 | Hunter | B65D 45/16 206/508 | |
| 5,967,363 | A * | 10/1999 | Allen | 220/806 | |
| 5,971,201 | A | 10/1999 | Daw | | |
| 6,189,725 | B1 | 2/2001 | Monico | | |
| 6,293,692 | B1 * | 9/2001 | Bowsher et al. | 366/130 | |
| 7,121,425 | B2 | 10/2006 | Shanabrook | | |
| 2002/0030058 | A1 * | 3/2002 | Bothwell | 220/700 | |
| 2003/0197013 | A1 * | 10/2003 | Conti et al. | 220/297 | |
| 2011/0036804 | A1 | 2/2011 | Letica | | |
| 2015/0001252 | A1 * | 1/2015 | Eberhardt | 222/109 | |

FOREIGN PATENT DOCUMENTS

| | | |
|---|---|---|
| WO | WO03076288 | 8/2003 |

* cited by examiner

*Primary Examiner* — James N Smalley
(74) *Attorney, Agent, or Firm* — George F. Wallace

(57) ABSTRACT

A self-draining container includes a main body and lid. Main body is formed of an impermeable material defining a cavity, and includes a rim with an annular sealing groove having a groove diameter and a lower groove portion with at least one aperture. A lid is formed of the impermeable or another impermeable material, and has an annular sealing member with a member diameter and a lower member portion that includes at least one downwardly extending protrusion. The sealing member can be frictionally and sealably disposed within the groove with the at least one protrusion being disposed through the at least one aperture.

3 Claims, 3 Drawing Sheets

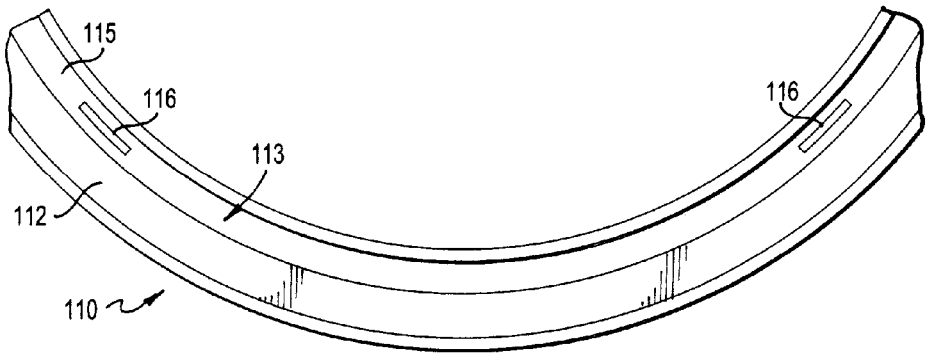
FIG. 2A
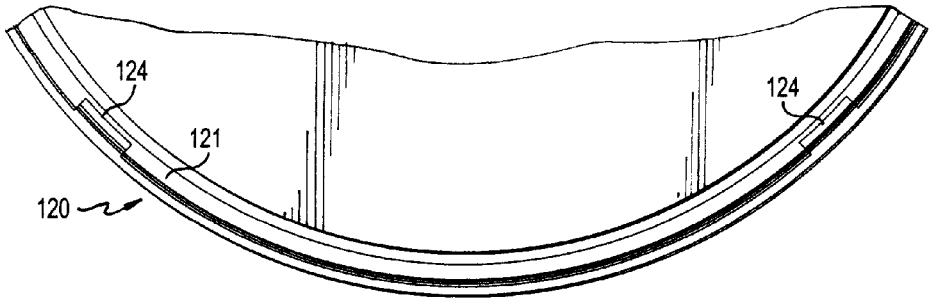
FIG. 2B
FIG. 3
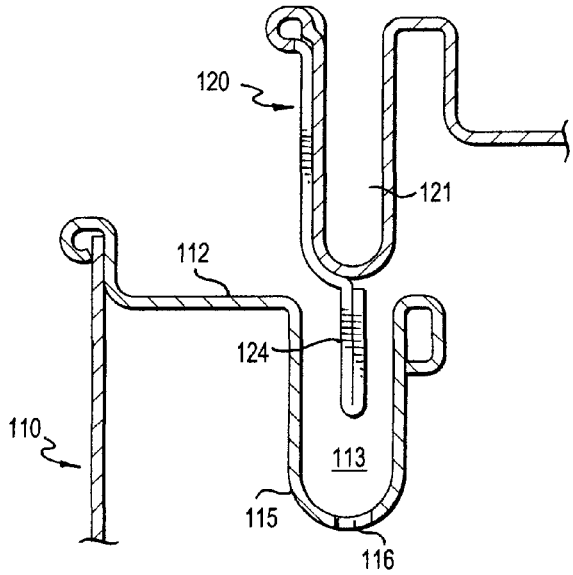

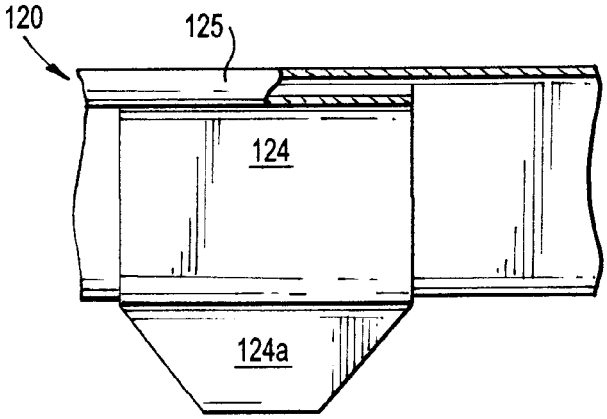
FIG. 4
FIG. 5A
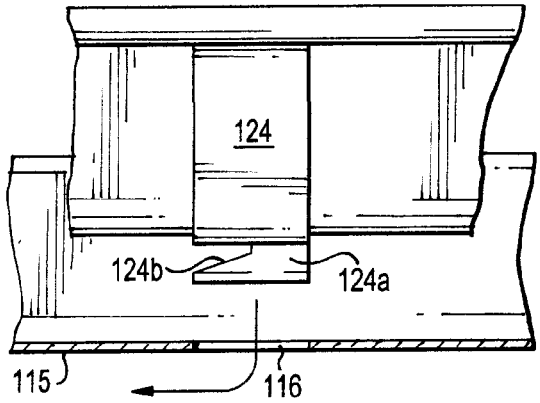
FIG. 5B
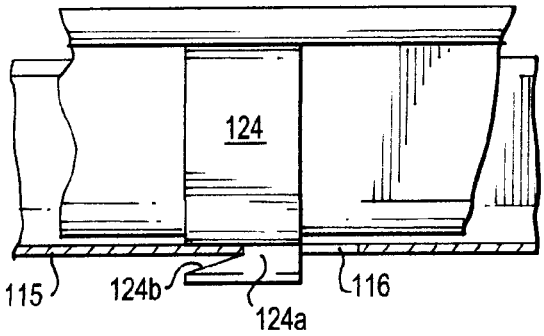

SELF-DRAINING CONTAINER

RELATED DOCUMENTS

This document is related to, incorporates in its entirety, and claims the priority benefit of U.S. Provisional Patent Application No. 61/961,423 filed on Oct. 15, 2013 by Jeffrey Michael Hutt.

FIELD OF THE INVENTION

The present invention relates to liquid containers, and more specifically, to self-draining liquid containers.

BACKGROUND OF THE INVENTION

Containers can be used to hold liquids, such as paint and other liquids. A paint container generally includes a cylindrical body with a round lid that engages the body by frictionally engaging a grooved portion of the body. During use, paint can become trapped within the grooved portion, and thus wasted.

A prior solution is the provisioning of apertures within such grooves, which can allow paint to drain back into the cavity of the container body. Such provisioning can be effectuated via a tool, such as ones disclosed in U.S. Pat. Nos. 7,121,425 and 5,212,869. Notably, despite utilization of such tools and provisioning of apertures for a draining feature, residual paint can remain within such grooves and over and/or adjacent to such apertures. Accordingly, subsequent engagement of a lid can create a thin layer of paint over such apertures, with such layers drying to form a solid layer of impermeable, dried paint that can cover such apertures, which can undesirably render an aperture's draining function ineffective. The present invention remedies this deficiency.

SUMMARY OF THE INVENTION

An object of the present invention is to provide a self-draining container.

Another object of the present invention is to provide a self-draining container that overcomes at least one deficiency within the prior art.

In an exemplary aspect of the present invention, a self-draining container can include a main body and a lid.

In an exemplary aspect of the present invention, a main body can be formed of an impermeable material that defines a cavity, and can include a rim that defines an opening. Further, such a rim can include an annular sealing groove having both a lower groove portion with at least one aperture and a groove diameter.

In another exemplary aspect of the present invention, a lid can be formed of the impermeable material or another impermeable material, and further, the lid can include an annular sealing member having, a lower member portion with at least one protrusion, and a member diameter complementarily sized with the groove diameter.

In a further exemplary aspect of the present invention, the annular sealing member can be sealably disposed within the sealing groove such that the at least one protrusion is disposed through the at least one aperture.

In another exemplary embodiment of the present invention, the lower groove portion can include a plurality of apertures, and the at least one protrusion can be disposed through at least one of the plurality of apertures.

In yet another exemplary embodiment of the present invention, the lower groove portion can include a plurality of apertures, the lower member portion can include a plurality of protrusions, and at least two of the plurality of protrusions can be disposed through at least two of the plurality of apertures.

The following exemplary aspects apply to any embodiment of the present invention:

any one or more protrusions can include a tapered portion, which can taper in at least one direction; and any one or more protrusions can include a horizontally tapered portion that forms a respective tapered slot, such that the lower groove portion can be frictionally engaged with at least one of the one or more protrusions between any one or more of the tapered slots.

BRIEF DESCRIPTION OF THE DRAWINGS

FIG. 2*a* illustrates a partial top-view perspective of an exemplary main body.

FIG. 2*b* illustrates a partial underside-view of an exemplary lid having an annular sealing member with at least one protrusion.

FIG. 3 illustrates a partial cross-section view of an exemplary main body and lid.

FIG. 4 illustrates a partial cross-section view of an exemplary lid having an optionally tapered protrusion crimped thereto via a crimp element.

FIG. 5*a* illustrates a partial cross-section view of an exemplary main body, and an exemplary lid having a protrusion with a horizontally tapered portion.

FIG. 5*b* illustrates another partial cross-section view of an exemplary main body, and an exemplary lid having a protrusion with a horizontally tapered portion engaged with a lower groove portion of the main body.

DETAILED DESCRIPTION

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of elements and/or aspects can enable a separate embodiment of a patentable invention, which may be claimed with particularity in this or any future filed Patent Applications. Moreover, such elements and/or aspects disclosed herein, whether expressly or implicitly, are to be construed strictly as illustrative and enabling, and not necessarily limiting. Therefore, it is expressly set forth that any elements and/or aspects, independently or in any combination of one of more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

The present invention provides an improved self-draining container.

In an exemplary aspect of the present invention, the present invention can be formed of any one or more impermeable materials that can functionally retain a liquid. Thus, any one or more of a plastic, rubber, metal, wood, elastomer, crystalline material, man-made material, and naturally-occurring material may be utilized insofar as the resulting material is impermeable within the spirit of the present invention. And notably, different portions of the present invention can be formed of the same or different materials to the extent desired.

Figure 1A:
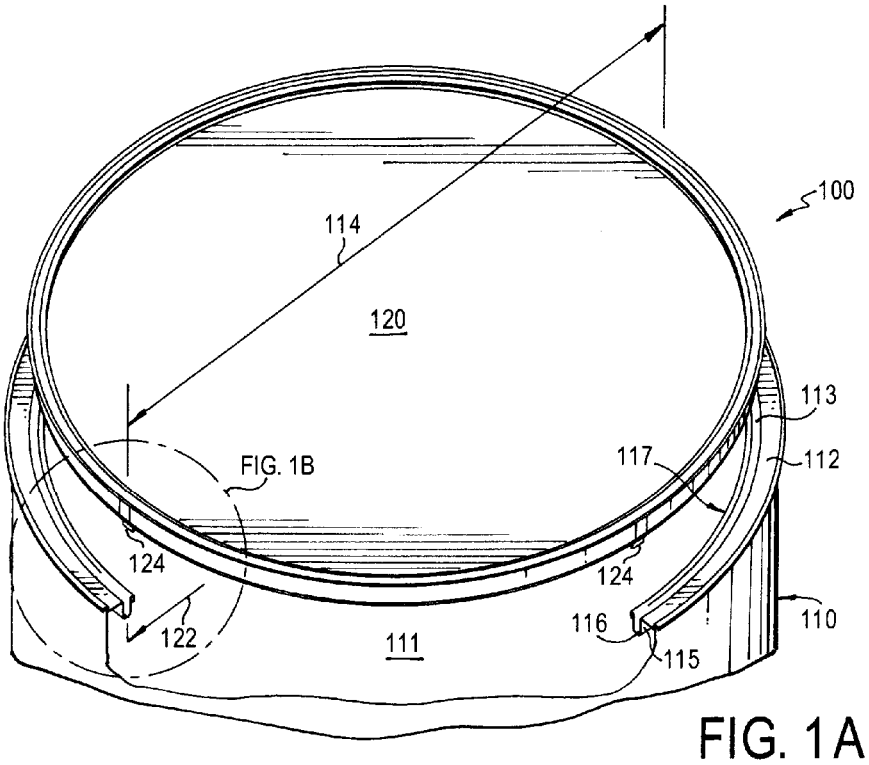
FIG. 1*a* illustrates a partial perspective of an exemplary self-draining container having a main body defining a cavity and a lid.
Figure 1B:
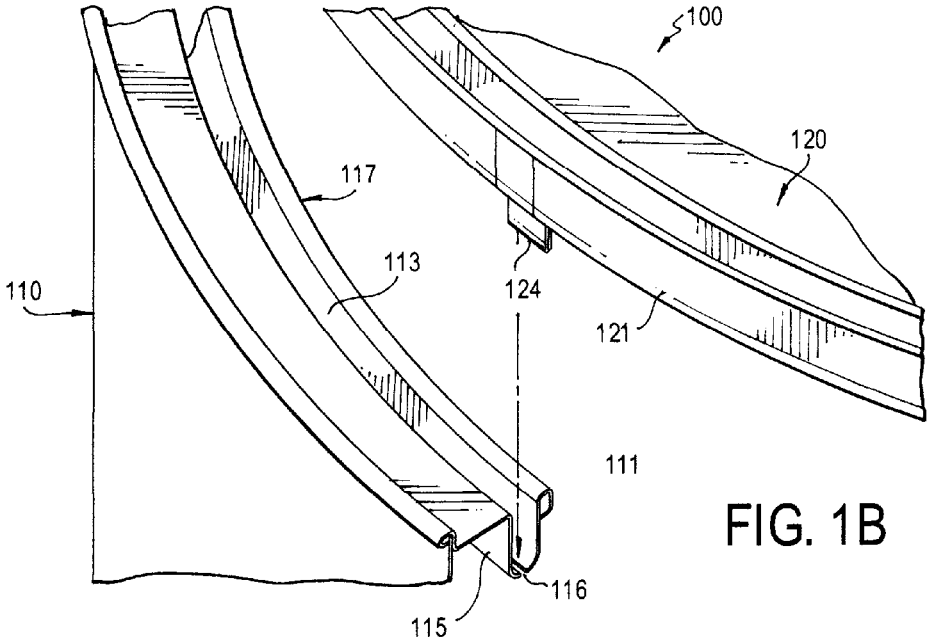
FIG. 1*b* illustrates a zoomed perspective of an exemplary protrusion and aperture.

FIG. 1*a* illustrates a partial view of an exemplary embodiment of the present invention, in which a self-draining container 100 can include a main body 110 defining a cavity 111, and a lid 120. FIG. 1*b* provides a partial, zoomed perspective of main body 110 and lid 120 to facilitate particular elements thereof.

In an exemplary aspect of the present invention, main body 110 can include a rim 112 with an annular sealing groove 113 having a groove diameter 114 and a lower groove portion 115 with at least one aperture 116 that can allow a liquid to drain into cavity 111 that is exposed by opening 117, which is defined by rim 112. Rim 112 can be provided as an integral component of main body 110. For example and not in limitation, rim 112 can be a molded component of main body 110. However, rim 112 can alternatively be a separately attached component. For example and not in limitation, rim 112 can be glued, welded, crimped (see FIG. 3*a*), or otherwise attached to main body 110.

In another exemplary aspect of the present invention, lid 120 can include an annular sealing member 121 with a member diameter 122 and a lower member portion 123 having at least one protrusion 124. Notably, each protrusion 124 can be strategically sized and positioned to fit within and align with an aperture 116.

As illustrated, member diameter 122 can be complementarily-sized with groove diameter 114, such that sealing member 121 can be frictionally and sealably disposed within sealing groove 113 with each protrusion 124 passing through an aperture 116.

FIG. 2*a* illustrates a partial top-view perspective of an exemplary main body 110. As illustrated, an aperture 116 can be provided with a rectangular shape; however, any alternative shape(s) (such as one or more of a square, triangular, symmetric, asymmetric, irregular, or any other geometric shape, for example and not in limitation) can be provided to the extent desired and complementary to the shape and size of a protrusion 124 such that the protrusion can fit therethrough.

FIG. 2*b* illustrates a partial bottom-view perspective of an exemplary lid 120. As illustrated, a protrusion 124 can be provided with a rectangular shape; however, an alternative shape(s) (such as one or more of a square, triangular, symmetric, asymmetric, irregular, or any other geometric shape, for example and not in limitation) can be utilized to the extent desired and complementary to the shape and size of an aperture 116, such that the protrusion can fit therethrough.

In another exemplary aspect of the present invention, a protrusion 124 can be provided as an integral component of lid 120. For example and not in limitation, a protrusion 124 can a molded component of lid 120 and/or sealing member 121. In an exemplary aspect, a lid 120 and/or sealing member 121 can be molded with a protrusion 124 in a single mold cavity. However, a protrusion 124 can alternatively be a separate component that is attached to sealing member 121. For example and not in limitation, a protrusion can be glued, welded, crimped, or otherwise attached to sealing member 121.

In another exemplary aspect of the present invention, there can be at least one aperture 116 for each protrusion 124.

FIG. 3 illustrates a cross-section of an exemplary main body 110 and lid 120. As noted above, protrusion 124 can be provided as an integral component of lid 120, such as, for example and not in limitation, where lid 120 is produced via a molding process, such as injection molding, for example and not in limitation. However, as illustrated in FIG. 3, a protrusion 124 can also be an integral component of lid 120 by way of bending of a bendable material (e.g., a metal), such as a flange being bent along sealing member 121 and extending downwardly to form the protrusion (and optionally, as illustratively shown in FIG. 3, back up to form a protrusion with plural layers).

FIG. 4 illustrates partial cross-section view of an exemplary lid 120 having a protrusion 124 crimped thereto via a crimp element 125. As further illustrated, protrusion 124 can include a tapered portion 124*a* that tapers in at least one direction, which in this example is downwardly, which can assist in disposing a protrusion 124 through an aperture 116 when sealably engaging lid 120 with main body 110.

FIGS. 5*a* and 5*b* illustrate partial cross-section views of an exemplary main body 110 and lid 120 in which a protrusion 124 can include a tapered portion 124*a* that tapers horizontally and forms a tapered slot 124*b*. Accordingly, after protrusion 124 is disposed through aperture 116, lid 120 can be rotated in the tapered direction of tapered portion 124*a*, lower groove portion 115 can frictionally engage the protrusion between tapered slot 124*b* to facilitate a secured engagement of lid 120 to main body 110.

Notably, in any embodiment of the present invention, the various elements can be provided in any desired shape and/or size that are functionally compatible with the present invention as described and/or claimed, and as expressly stated, are not necessarily limited to any particular shape or size illustratively described herein. Accordingly, exemplary shapes and/or sizes can include any shape or size having one or more geometric shapes, whether having symmetric or asymmetric portions, and without shape or size limitations relative to other elements unless necessary to the functionality of the present invention.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore I claim:

1. A self-draining container, comprising:

a main body, formed of an impermeable material defining a cavity, and including a rim with an annular sealing groove having a groove diameter and a lower groove portion with at least one aperture that exposes the cavity, the rim defining an opening of said main body;

a lid, formed of one of the impermeable material and another impermeable material, said lid having an annular sealing member with a member diameter and a lower member portion including at least one downwardly extending protrusion, the member diameter being complementarily sized with the groove diameter;

wherein the sealing member is frictionally and sealably disposed within the groove with the at least one protrusion disposed through the at least one aperture, and the at least one protrusion is formed of a unitary piece of construction that extends along a side of the sealing member, extends downwardly below the sealing member, and extends upwardly back towards the sealing member to form a U shape.

2. The container of claim 1, wherein the lower groove portion include a plurality of apertures, and the at least one protrusion is disposed through at least one of the plurality of apertures.

3. The container of claim 1, wherein the lower groove portion includes a plurality of apertures, the lower member portion includes a plurality of protrusions, and each of the plurality of protrusions is respectively formed of a respective unitary piece of construction that extends along the side of the sealing member, extends downwardly below the sealing member, and extends upwardly back towards the sealing member to form a U shape.

* * * * *